US006413327B1

(12) United States Patent
Okajima et al.

(10) Patent No.: US 6,413,327 B1
(45) Date of Patent: Jul. 2, 2002

(54) NITRIDE TYPE, RARE EARTH MAGNET MATERIALS AND BONDED MAGNETS FORMED THEREFROM

(75) Inventors: Hiroshi Okajima; Masahiro Tobise; Mikio Shindo, all of Saitama-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/463,430

(22) PCT Filed: May 25, 1999

(86) PCT No.: PCT/JP99/02746

§ 371 (c)(1),
(2), (4) Date: Apr. 13, 2000

(87) PCT Pub. No.: WO99/62081

PCT Pub. Date: Dec. 2, 1999

(30) Foreign Application Priority Data

May 26, 1998 (JP) ..... 10-161375

(51) Int. Cl.[7] ..... H01F 1/055; H01F 1/057
(52) U.S. Cl. ..... 148/301; 148/302
(58) Field of Search ..... 148/301, 302, 148/303; 252/62.55

(56) References Cited

U.S. PATENT DOCUMENTS 5,186,766 A * 2/1993 Iriyama et al. ..... 148/301
5,362,336 A * 11/1994 Yamaguchi et al. ..... 148/301
5,403,407 A * 4/1995 Hadjipanayis et al. ..... 148/301
5,658,396 A * 8/1997 Sakurada et al. ..... 148/301
5,750,044 A * 5/1998 Yoneyama et al. ..... 252/62.54
5,769,969 A * 6/1998 Ishikawa et al. ..... 148/301
5,858,123 A * 1/1999 Uchida et al. ..... 148/302
5,968,290 A * 10/1999 Sakurada et al. ..... 148/302

FOREIGN PATENT DOCUMENTS

| | | | |
|---|---|---|---|
| JP | 04260302 A | | 9/1992 |
| JP | 04323350 A | | 11/1992 |
| JP | 8-37122 | * | 2/1996 |
| JP | 8-37122 A | | 6/1996 |
| WO | WO 94/05021 | | 3/1994 |

* cited by examiner

*Primary Examiner*—John Sheehan
(74) *Attorney, Agent, or Firm*—Sughrue Mion, PLLC

(57) ABSTRACT

A nitride-type, rare earth magnet material having a basic composition represented by $R_\alpha T_{100-(\alpha+\beta+\gamma+\delta)} M_\beta B_\gamma N_\delta$ (atomic %), wherein R is at least one rare earth element including Y, as a rare earth element Sm must be present, T is Fe alone or a combination of Fe and Co and/or Ni, M is at least one element selected from the group consisting of Al, Ti, V, Cr, Mn, Cu, Ga, Zr, Nb, Mo, Hf, Ta, W and Zn, $6 \leqq \alpha \leqq 15$, $0.5 \leqq \beta \leqq 10$, $0 \leqq \gamma \leqq 4$, and $4 \leqq \delta \leqq 30$, which is substantially composed of a hard magnetic phase of an $R_2T_{17}$-type structure having an average crystal grain size of 0.01–1 $\mu$m, an average area ratio of $\alpha$-Fe being 5% or less.

9 Claims, 8 Drawing Sheets

100 n m

NITRIDE TYPE, RARE EARTH MAGNET MATERIALS AND BONDED MAGNETS FORMED THEREFROM

FIELD OF THE INVENTION

The present invention relates to a nitride-type, rare earth magnet material made of an R—T—M(—B)—N alloy and an isotropic, bonded rare earth magnet formed from such a nitride-type, rare earth magnet material, particularly to a nitride-type, rare earth magnet material comprising Sm and La as R and an isotropic, bonded rare earth magnet having good magnetizability.

BACKGROUND OF THE INVENTION

Bonded rare earth magnets comprising Nd—Fe—B magnet powder have conventionally been used widely, though their applications at high temperatures are restricted because they have as low Curie temperatures as about 300° C. and high temperature coefficients of coercivity iHc.

$Sm_2Fe_{17}N_x$ compounds formed by making $Sm_2Fe_{17}$ compounds absorb nitrogen have recently been finding industrial applications as magnet powder for bonded magnets, because they show higher Curie temperatures (470° C.) and anisotropic magnetic field (260 kOe) than those of $Nd_2Fe_{14}B$ compounds. However, $Sm_2Fe_{17}N_x$ compounds fail to show usefully high iHc unless they are pulverized to as small a particle size as a few $\mu$m, corresponding to the size of a single magnetic domain. Also, $Sm_2Fe_{17}N_x$ compounds in a state of fine powder having a few $\mu$m size are easily oxidized in the air at room temperature, resulting in drastic deterioration of their magnetic properties. In addition, $Sm_2Fe_{17}N_x$ compounds in a state of fine powder having a few $\mu$m cannot be filled in the bonded magnets at high density, failing to achieve usefully high maximum energy products $(BH)_{max}$.

To solve the above problems in connection with fine pulverization, Japanese Patent Laid-Open No. 4-260302 describes that nitrided magnet powder having a composition comprising 5–15 atomic % of Sm, 0–10 atomic % of M which is at least one element selected from the group consisting of Zr, Hf, Nb, Ta, W, Mo, Ti, V, Cr, Ga, Al, Sb, Pb and Si, and 0.5–25 atomic % of N, the balance being substantially Fe or Fe and Co (Fe content is 20 atomic % or more) is obtained by heat-treating the $Sm_2Fe_{17}$ compounds in a hydrogen atmosphere and then under reduced pressure and further nitriding it, and that when M is contained, the resultant magnet powder has an average crystal grain size of 1 $\mu$m or less and an average particle size of 20 $\mu$m or more, showing magnetic anisotropy. The inventors' research has revealed, however, that the nitrided magnet powder produced under the conditions of Japanese Patent Laid-Open No. 4-260302 is magnetically isotropic, having an average crystal grain size of more than 1 $\mu$m. The reason therefor is considered that a hydrogen absorption temperature in Examples of Japanese Patent laid-Open No. 4-260302 is as low as 650° C., lower than a hydrogenation/decomposition temperature.

As a result of the inventors' investigation, it has been found that nitrided magnet powder having an average particle size of 10 $\mu$m or more and an average crystal grain size of 1 $\mu$m or less can be produced, when thin ribbons obtained from a mother alloy melt for a nitride-type, rare earth magnet material by rapid quenching at as high a peripheral speed of a quenching roll as, for instance, 45 m/sec. or more are heat-treated under the conditions of Japanese Patent Laid-Open No. 4-260302 and then nitrided. However, because thin mother alloy ribbons rapidly-quenched under the above conditions are extremely as thin as less than 50 $\mu$m, magnet powders obtained by finally nitriding them have ragged shapes, reflecting the shapes of the thin ribbons. As a result, such magnet powders cannot be compression-molded well. Accordingly, such nitrided magnet powder cannot be formed into isotropic, bonded magnets having as high a density as more than 6.1 g/cm$^3$, making less likely the expectation that $(BH)_{max}$ is improved by increasing the filling density of the nitrided magnet powder.

Magnetizability is extremely important for isotropic, bonded rare earth magnets, and a magnetic field intensity for magnetization is preferably 25 kOe or less at room temperature in practical applications. However, conventional R—T—M—N-type, isotropic, bonded rare earth magnets are not well magnetized under the above conditions.

OBJECT OF THE INVENTION

Accordingly, an object of the present invention is to provide a nitride-type, rare earth magnet material of an R—T—M(—B)—N alloy, particularly a (Sm, La)—T—M(—B)—N alloy, wherein R is at least one rare earth element including Y, as a rare earth element Sm must be present, T is Fe alone or a combination of Fe and Co and/or Ni, and M is at least one element selected from the group consisting of Al, Ti, V, Cr, Mn, Cu, Ga, Zr, Nb, Mo, Hf, Ta, W and Zn, the nitride-type, rare earth magnet material containing an extremely small amount of $\alpha$-Fe, if any, and being substantially composed of a fine, hard magnetic phase of an $R_2T_{17}$-type structure.

Another object of the present invention is to provide an isotropic, bonded rare earth magnet containing such a nitride-type, rare earth magnet material and having good magnetizability.

DISCLOSURE OF THE INVENTION

With respect to nitride-type, rare earth magnet material powder and an isotropic, bonded rare earth magnet containing such magnet powder, research has been carried out to achieve the following objectives:

(1) To provide nitride-type, rare earth magnet material particles substantially composed of a hard magnetic phase of $R_2T_{17}$-type structure, $\alpha$-Fe being preferably 5% or less, more preferably 2% or less, particularly 0% by average area ratio;

(2) To provide a small decrease in magnetic properties by temperature elevation (good heat resistance);

(3) To provide high $(BH)_{max}$;

(4) To easily form isotropic, bonded rare earth magnets under practical molding pressure;

(5) To provide bonded rare earth magnets with magnetizability sufficient for practical applications; and (6) To provide bonded rare earth magnets having a density of more than 6.1 g/cm$^3$.

As a result, it has been found that nitride-type, rare earth magnet materials satisfying the above requirements (1)–(6) can be produced by preparing by a melting method a mother alloy having a composition corresponding to the basic composition of an R—T—M(—B)—N-type, nitrided rare earth magnet alloy, wherein R is at least one rare earth element including Y, Sm being indispensable, T is Fe alone or Fe and Co and/or Ni, and M is at least one element selected from the group consisting of Al, Ti, V, Cr, Mn, Cu, Ga, Zr, Nb, Mo, Hf, Ta, W and Zn, and subjecting the resultant mother alloy to a homogenizing heat treatment at 1010–1280° C. for 1–40 hours in an inert gas atmosphere containing no nitrogen, if necessary, and then to a hydrogenation/decomposition reaction treatment, a dehydrogenation/recombination reaction treatment and a nitriding treatment in this order.

It has particularly been found that nitride-type, rare earth magnet materials satisfying the above requirements (1)–(6) can be produced by rapidly cooling a mother alloy melt having a composition corresponding to the basic composition of an R—T—M—B—N nitride-type, magnet alloy, wherein R is at least one rare earth element including Y, as a rare earth element Sm must be present, T is Fe alone or a combination of Fe and Co and/or Ni, and M is at least one element selected from the group consisting of Al, Ti, V, Cr, Mn, Cu, Ga, Zr, Nb, Mo, Hf, Ta, W and Zn, wherein Ti must be present, at a peripheral speed of a quenching roll that is preferably 0.05–15 m/second, more preferably 0.08–10 m/second, particularly preferably 0.1–8 m/second, and then subjecting the resultant quenched alloy to a hydrogenation/decomposition reaction treatment and a dehydrogenation/recombination reaction treatment described below, and then to a nitriding treatment. It has further been found that a combination of Sm and La is advantageously selected as the R element to improve the magnetizability. The present invention has been completed based on these findings.

Thus, the nitride-type, rare earth magnet material according to the present invention has a basic composition represented by:

$$R_{60}\,T_{100-(\alpha+\beta+\gamma+\delta)}M_{\beta}B_{\gamma}N_{\delta}\ \text{(atomic \%)},$$

wherein R is at least one rare earth element including Y, as a rare earth element Sm must be present, T is Fe alone or a combination of Fe and Co and/or Ni, M is at least one element selected from the group consisting of Al, Ti, V, Cr, Mn, Cu, Ga, Zr, Nb, Mo, Hf, Ta, W and Zn, $6 \leqq \alpha \leqq 15$, $0.5 \leqq \beta \leqq 10$, $0 \leqq \gamma 4$, and $4 \leqq \delta \leqq 30$, the nitride-type, rare earth magnet material being substantially composed of a hard magnetic phase of an $R_2T_{17}$-type structure having an average crystal grain size of 0.01–1 $\mu$m, and an average area ratio of $\alpha$-Fe being 5% or less.

The nitride-type, rare earth magnet material according to a preferred embodiment of the present invention has a basic composition in which M is at least one element selected from the group consisting of Al, Ti, V, Cr, Mn, Cu, Ga, Zr, Nb, Mo, Hf, Ta, W and Zn, wherein Ti must be present, and $6 \leqq \alpha \leqq 15$, $0.5 \leqq \beta \leqq 10$, $0 \leqq \gamma 4$, and $4 \leqq \delta \leqq 30$. This basic composition provides a mother alloy with an average $\alpha$-Fe area ratio of 5% or less without a homogenizing heat treatment. In this case, the content ($\beta$) of the M element including Ti should be 0.5–10 atomic %, more preferably 1–6 atomic %, particularly preferably 1–4 atomic %, and that the content of Ti should be 0.5 atomic % or more.

The nitride-type, rare earth magnet material according to another preferred embodiment of the present invention has a basic composition represented by $(Sm, La)_{\alpha}T_{100-(\alpha+\beta+\gamma+\delta)}M_{\beta}B_{\gamma}N_{\delta}$ (atomic %), wherein T is Fe alone or a combination of Fe and Co and/or Ni, M is at least one element selected from the group consisting of Al, Ti, V, Cr, Mn, Cu, Ga, Zr, Nb, Mo, Hf, Ta, W and Zn, and $6 \leqq \alpha \leqq 15$, $0.5 \leqq \beta \leqq 10$, $0 \leqq \gamma 4$, and $4 \leqq \delta \leqq 30$. This nitride-type, rare earth magnet material substantially has a hard magnetic phase of a $(Sm, La)_2T_{17}$-type structure having a average crystal grain size of 0.01–1 $\mu$m, and an average area ratio of $\alpha$-Fe being 5% or less. The content of La is preferably 0.05–1 atomic % per 100 atomic % of the overall basic composition.

In a further preferred embodiment of the present invention, the hard magnetic phase is composed of a mixed crystal of a rhombohedral crystal having a $Th_2Zn_{17}$-type structure and a hexagonal crystal having a $Th_2Ni_{17}$-type structure.

In a still further preferred embodiment of the present invention, the nitride-type, rare earth magnet material is in the form of powder having a one-peak particle size distribution with an average particle size of 10–300 $\mu$m.

In a still further preferred embodiment of the present invention, the nitride-type, rare earth magnet material contains as inevitable impurities 0.25 weight % or less of oxygen and 0.1 weight % or less of carbon.

The bonded rare earth magnet according to the present invention is produced by bonding the above nitride-type, rare earth magnet material powder with a binder resin. The binder resin is preferably a thermosetting resin. The bonded rare earth magnet preferably has a density of more than 6.1 g/cm$^3$ by compression molding and a subsequent heat curing treatment.

BRIEF DESCRIPTION OF THE DRAWINGS

FIG. 3(*b*) is an electron diffraction pattern of a nitride-type, rare earth magnet material of No. 7 in EXAMPLE 1, indicating the existence of a rhombohedral crystal of a $Th_2Zn_{17}$-type structure;

FIG. 7(*b*) is a graph showing the relation between the intensity of a magnetizing field and Hk in isotropic, bonded magnets of No. 101 in EXAMPLE 5 and No. 122 in EXAMPLE 6.

DETAILED DESCRIPTION OF THE PREFERRED EMBODIMENTS

Figure 1:
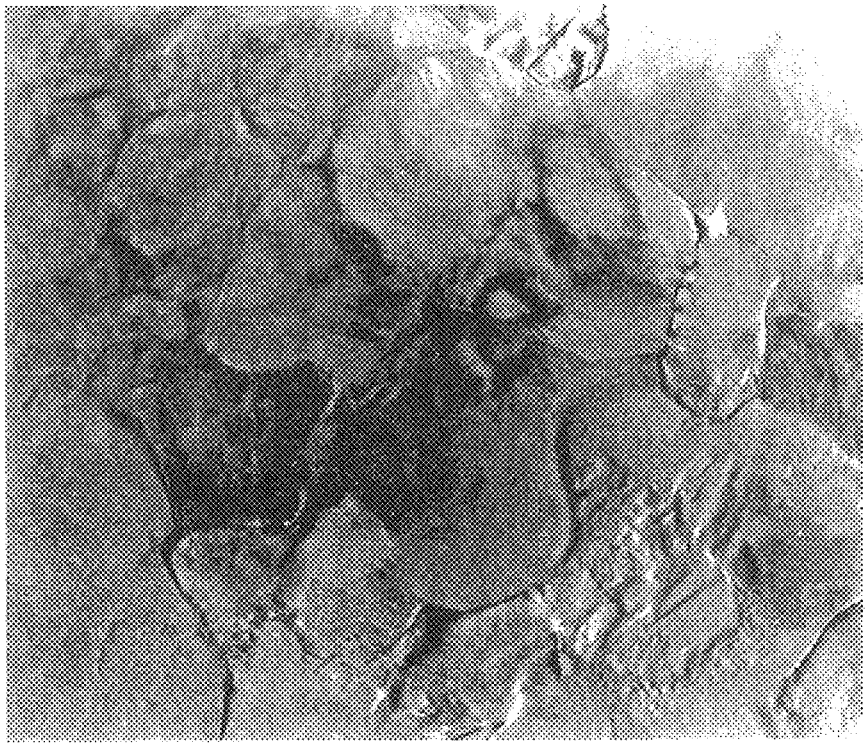
FIG. 1 is a transmission electron microscopic photograph showing the structure of a nitride-type, rare earth magnet material of No. 33 in EXAMPLE 2.

[1] Nitride-type, Rare Earth Magnet Material (A) Composition

The nitride-type, rare earth magnet material of the present invention has, in addition to inevitable impurities, a basic composition represented by:

$$R_{\alpha}T_{100-(\alpha+\beta+\gamma+\delta)}M_{\beta}B_{\gamma}N_{\delta}\ \text{(atomic \%)},$$

wherein R is at least one rare earth element including Y, as a rare earth element Sm must be present, T is Fe alone or a combination of Fe and Co and/or Ni, M is at least one element selected from the group consisting of Al, Ti, V, Cr, Mn, Cu, Ga, Zr, Nb, Mo, Hf, Ta, W and Zn, $6 \leqq \alpha \leqq 15$, $0.5 \leqq 0 \leqq 10$, $0 \leqq \gamma 4$, and $4 \leqq \delta \leqq 30$.

(1) Rare Earth Element R

In the nitride-type, rare earth magnet material of the present invention, R is at least one rare earth element including Sm as an indispensable element, and a rare earth element other than Sm is at least one element selected from the group consisting of Y, La, Ce, Pr, Nd, Eu, Gd, Th, Dy, Ho, Er, Tm, Yb and Lu. Mixtures of two or more rare earth elements such as misch metals or didymium may also be used as the rare earth elements. Though substantially Sm alone may be used, two or more rare earth elements R may be used. In such a case, another rare earth element combined with Sm is preferably at least one element selected from the group consisting of La, Y, Ce, Pr, Nd, Gd, Dy and Er, more preferably at least one element selected from the group consisting of La, Y, Ce, Pr and Nd. A particularly preferable rare earth element R is Sm alone or Sm+La. To achieve good iHc, the percentage of Sm per the total rare earth element R is preferably 50 atomic % or more, more preferably 70 atomic % or more.

When the rare earth element R is Sm and La, and when the content of La is 0.05–1 atomic %, the nitride-type, rare earth magnet material has extremely improved magnetizability. When the La content is less than 0.05 atomic %, enough improvement of magnetizability cannot be obtained. On the other hand, when it exceeds 1 atomic %, the rare earth magnet material rather has a decreased squareness ratio expressed by Hk. Incidentally, when the La content is 0.05–1 atomic S, the isotropic, bonded magnets magnetized at 25 kOe or less at room temperature have increased $(BH)_{max}$, and Hk, though they show slightly low anisotropic magnetic field and saturated magnetic flux density Bs. Here, Hk is a value of H at a position of 0.7 Br on a $4\pi I$-H demagnetization curve, serving as a measure indicating the rectangularity of the demagnetization curve. Br is a residual magnetic flux density, H is the intensity of a magnetic field, and $4\pi I$ is the intensity of magnetization.

The content a of the rare earth element R is 6–15 atomic % per the total basic composition (100 atomic %). When R is less than 6 atomic %, e nitride-type, rare earth magnet material has too low iHc. On the other hand, when R exceeds 15 atomic %, the saturation magnetization a decreases. The preferred content of R is 7–12 atomic %.

(2) M Element

The M element is at least one element selected from the group consisting of Al, Ti, V, Cr, Mn, Cu, Ga, Zr, Nb, Mo, Hf, Ta, W and Zn, and it is preferably Ti. The M element may be a combination of these elements.

The content β of the M element is 0.5–10 atomic %, preferably 1–6 atomic %, more preferably 1–4 atomic %, per the total basic composition (100 atomic %). When the content (3 of the M element is less than 0.5 atomic %, sufficient magnetic properties cannot be achieved. On the other hand, when the content (3 of the M element exceeds 10 atomic %, a $Sm(Fe, M)_{12}N_{\delta}$ phase of a $ThMn_{12}$-type is generated, resulting in decrease in magnetic properties.

Particularly when Ti is contained as the M element, the resultant nitride-type, rare earth magnet material preferably has good magnetic properties such as a coercivity iHc, a maximum energy product (BH)max, a temperature coefficient of coercivity iHc, a squareness ratio, etc. Also, when a mother alloy melt having a composition corresponding to the above basic composition containing the M element including Ti and the B element in proper amounts is subjected to rapid quenching under the above conditions, a mother alloy substantially free from α-Fe can be obtained without a homogenizing heat treatment.

When Ti is contained, the content of Ti is preferably 0.5 atomic % or more, more preferably 1 atomic % or more within the above range of β.

When the content of the M element is 5 atomic % or more, the hard magnetic phase is composed of a mixed crystal of a rhombohedral crystal having a $Th_2Zn_{17}$-type structure and a hexagonal crystal having a $Th_2Ni_{17}$-type structure, resulting in good magnetic properties such as a coercivity iHc, a maximum energy product $(BH)_{max}$, a temperature coefficient of coercivity iHc, a squareness ratio, etc.

When the homogenizing heat treatment is carried out, the M element needs not contain Ti, and B is not necessary as described below. In this case, the content P of the M element may be preferably 0.5–10 atomic %, more preferably 1–6 atomic %, particularly preferably 1–4 atomic % for the same reasons as described above.

(3) Boron B

The content γ of boron B is 0–4 atomic %, preferably 0.1–4 atomic %, more preferably 1–4 atomic %, per the total basic composition (100 atomic %). When the content of B exceeds 4 atomic %, the nitride-type, rare earth magnet material has decreased iHc and σ. With respect to the lower limit of the B content, it may be 0%, meaning that B is not indispensable, when the homogenizing heat treatment is carried out. On the other hand, when the homogenizing heat treatment is not carried out, less than 0.1 atomic % of B leads to decrease in iHc.

(4) Nitrogen

The content δ of nitrogen is 4–30 atomic %, preferably 10–20 atomic %, per the total basic composition (100 atomic %). When the content of nitrogen is less than 4 atomic % or exceeds 30 atomic %, the nitride-type, rare earth magnet material shows drastically decreased iHc and σ.

(5) T Element

The T element is Fe alone or a combination of Fe and Co and/or Ni, preferably Fe alone or Fe+Co. When Co and/or Ni is added, its content is preferably 0.5–30 atomic %, more preferably 1–20 atomic %, per the total basic composition (100 atomic %). The addition of Co and/or Ni serves to provide the nitride-type, rare earth magnet material with improved Curie temperature and temperature coefficient η of iHc. When the content of Co and/or Ni exceeds 30 atomic %, the nitride-type, rare earth magnet material shows drastically decreased iHc and σ. On the other hand, when it is less than 0.5 atomic %, sufficient effects of addition cannot be obtained. The remainder of the T element is Fe.

(6) Other Elements

The added elements such as rare earth elements R contain small amounts of inevitable impurities such as O, H, C, Si, Na, Mg, Ca, etc., which are inevitably contained in their production processes. Though the contents of inevitable impurities are preferably as small as possible, no problems are caused as long as oxygen is 0.25 weight % or less and carbon is 0.1 weight % or less. When the content of carbon is 0.1 weight % or less, the precipitation of an α-Fe phase is preferably suppressed. Also, the content of hydrogen may be about 0.01–10 atomic %.

(B) Structure

The nitride-type, rare earth magnet material of the present invention is substantially composed of a hard magnetic phase of an $R_2T_{17}$-type structure having an average crystal grain size of 0.01–1 μm, and the average area ratio of α-Fe is 5% or less.

(1) Hard Magnetic Phase

The hard magnetic phase has an $R_2T_{17}$-type structure. The hard magnetic phase may be composed of a mixed crystal of a rhombohedral crystal having a $Th_2Zn_{17}$-type structure and a hexagonal crystal having a $Th_2Ni_{17}$-type structure.

When the average crystal grain size of the hard magnetic phase is 0.01–1 μm, high magnetic properties can be obtained. It is difficult from he viewpoint of commercial production to stably obtain a hard magnetic phase having an average crystal grain size of less than 0.01 μm. Also, when the average crystal grain size of the hard magnetic phase exceeds 1 μm, the nitride-type, rare earth magnet material shows drastically decreased iHc. The preferred average crystal grain size of the hard magnetic phase is 0.01–0.5 μm.

Incidentally, the average crystal grain size $dc_{av}$ of the hard magnetic phase is measured as follows. First, powder of the nitride-type, rare earth magnet material is mixed with powder of an acrylic resin at a predetermined ratio, and heated under pressure to obtain a sample of magnet material powder dispersed in a transparent acrylic resin. This sample is ground such that the cross section of magnet material powder is exposed. Arbitrarily selected five view fields of this sample are photographed by a transmission electron microscope (TEM) to obtain TEM photographs of cross section structures of the magnet material powder. In the TEM photograph of a cross section structure in each view field, diagonal lines are drawn, and the total length of diagonal line portions occupied by crystal grains is divided by the number of the crystal grains to determine $dc_1$ and $dc_2$ in each view field. These $dc_1$ and $dc_2$ are averaged to obtain $dc_{av}$.

(2) α-Fe Phase

To obtain high magnetic properties, the structure of the nitride-type, rare earth magnet material preferably contains as few α-Fe phase as possible. The upper limit of the α-Fe phase is 5%. When the average area ratio of the α-Fe phase exceeds 5%, iHc and its temperature coefficient η decrease. The preferred average area ratio of the α-Fe phase is 2% or less.

The identification of the hard magnetic phase and α-Fe and the calculation of their average area ratios are carried out, using the results of electron and/or optical microscopic observation, and if necessary, the results of X-ray diffraction analysis. For instance, the transmission electron microscopic (TEM) photograph taken on a cross section of a sample of nitride-type, rare earth magnet material powder is compared with the identification results of this structure to carry out the identification of the hard magnetic phase and α-Fe and the calculation of their average area ratios.

(C) Shape

The nitride-type, rare earth magnet material of the present invention is preferably in the form of powder having an average particle size of 10–300 μm. When the average particle size is less than 10 μm, the nitride-type, rare earth magnet material powder is likely to be severely oxidized and subjected to remarkable deterioration in moldability. On the other hand, when it exceeds 300 μm, the nitride-type, rare earth magnet material powder tends to have a non-uniform nitride structure, resulting in decrease in magnetic properties. The more preferred average particle size is 20–200 μm. Particularly useful for practical applications is nitride-type, rare earth magnet material powder having a one-peak particle size distribution.

[2] Production Method of Nitride-type, Rare Earth Magnet Material (A) Preparation of Mother Alloy A mother alloy of the nitride-type, rare earth magnet material is prepared by a high-frequency melting method, an arc melting method, a strip-casting method, an atomizing method, etc. The mother alloy has a R—T—M(—B) composition that is substantially the same as the basic composition of the nitride-type, rare earth magnet material except for containing no nitrogen.

A mother alloy melt is rapidly quenched by a strip-casting method, an atomizing method, etc. to obtain a mother alloy in which the formation of α-Fe is suppressed. The cooling speed of the mother alloy melt is determined, such that the resultant thin ribbon or powder has α-Fe deposited in an average area ratio of only 5% or less and a uniform structure. Specifically, the cooling speed of the mother alloy melt is preferably about $1\times10^2$ to $1\times10^{4}$° C./second. The thin ribbon produced by a strip-casting method preferably has a thickness of about 0.05–3 mm, and the powder produced by an atomizing method preferably has an average particle size of 10–300 μm.

(B) Homogenizing Heat Treatment

When the resultant nitride-type, rare earth magnet material contains α-Fe, it has a decreased coercivity iHc. Therefore, the content of α-Fe is preferably as small as possible in the nitride-type, rare earth magnet material. To achieve iHc≧5 kOe, the content of α-Fe should be 5% or less by average area ratio. When the content of α-Fe in the mother alloy is more than 5% by average area ratio, it is preferable to carry out a homogenizing (solution) heat treatment to dissolve α-Fe in the matrix of the mother alloy.

The homogenizing heat treatment is preferably carried out by heating at 1010–1280° C. for 1–40 hours in an inert gas atmosphere containing no nitrogen. With less than 1010° C.×1 hour, the dissolving of α-Fe in the matrix is not enough. On the other hand, with more than 1280° C.×40 hours, the effects of the homogenizing heat treatment are saturated, causing problems that the composition of the mother alloy extremely deviates from the target composition by the evaporation of Sm, etc. Incidentally, when the homogenizing heat treatment is carried out, B and Ti are not necessarily indispensable.

(C) Coarse Pulverization

After an ingot produced by a high-frequency melting method or an arc melting method is subjected to a homogenizing heat treatment, it is pulverized to coarse powder having a particle size of several mm by a jaw crusher, a hammer mill, etc.

(D) Hydrogenation/decomposition Reaction Treatment

The coarse powder or thin ribbon of the mother alloy subjected to a homogenizing heat treatment, if necessary, is subjected to a hydrogenation/decomposition reaction treatment that comprises heating at 675–900° C. for 0.5–8 hours in a hydrogen gas at 0.1–10 atm or in an inert gas atmosphere (excluding a nitrogen gas) having a hydrogen partial pressure of 0.1–10 atm. By the hydrogenation/decomposition reaction, the mother alloy is decomposed to a hydride $RH_x$ of rare earth element R, a T—M phase, etc.

When the hydrogen partial pressure of the hydrogenation/decomposition reaction atmosphere is less than 0.1 atm, the mother alloy is hardly decomposed. On the other hand, when the hydrogen partial pressure exceeds 10 atm, a treatment apparatus should be large, leading to high cost. Therefore, the hydrogen partial pressure is preferably 0.1–10 atm, more preferably 0.5–5 atm.

When the heating conditions of the hydrogenation/decomposition reaction are less than 675° C. (substantially corresponding to a hydrogenation/decomposition temperature)×0.5 hours, the mother alloy merely absorbs hydrogen, failing to cause decomposition to RH,, a T—M phase, etc. On the other hand, when they are more than 900° C.×8 hours, the dehydrogenated mother alloy becomes coarse powder, resulting in drastic decrease in iHc in the resultant nitride-type, rare earth magnet material powder. Therefore, the heating conditions of the hydrogenation/decomposition reaction are preferably 675–900° C.×0.5–8 hours, more preferably 675–800° C.×0.5–8 hours.

(E) Dehydrogenation/recombination Reaction Treatment

The mother alloy subjected to the hydrogenation/decomposition reaction is then subjected to a dehydrogenation/recombination reaction treatment that comprises beating at 700–900° C. for 0.5–10 hours in high vacuum of $1\times10^{-1}$ Torr or less. By the dehydrogenation/recombination reaction, the hydride $RH_x$, the T—M phase, etc. are recombined with a mother alloy phase, thereby forming a mother alloy composed of fine recrystallized particles having an average crystal grain size of 0.01–1 μm. Individual recrystallized particles are usually randomly oriented.

When the atmosphere of the dehydrogenation/recombination reaction is at lower vacuum degree than $1\times10^{-1}$ Torr, it takes too long time for the treatment. On the other hand, when the atmosphere is at higher vacuum degree than $1\times10^{-6}$ Torr, a vacuum apparatus is too expensive. When the heating conditions of the dehydrogenation/recombination reaction are less than 700° C.×0.5 hours, the decomposition of $RH_x$, etc. does not proceed. On the other hand, when they are more than 900° C.×10 hours, the recrystallized structure becomes coarse, resulting in drastic decrease in iHc. The more preferable heating conditions of the dehydrogenation/recombination reaction are 725–875° C.×0.5–10 hours.

(F) Pulverization

The mother alloy subjected to the dehydrogenation/recombination reaction is then pulverized to a desired particle size, if necessary. Particularly when the mother alloy is a thin ribbon obtained by a strip-casting method, it is preferably pulverized to a predetermined average particle size. Also, the classification or sieving of the pulverized mother alloy is carried out, if necessary, to adjust its particle size distribution. This is preferable, because it provides a uniform nitride structure, resulting in improved moldability and density of a bonded magnet.

(G) Nitriding Treatment

The mother alloy powder adjusted to a predetermined particle size is subjected to a nitriding treatment to obtain a nitride-type, rare earth magnet material having the basic composition of the present invention. The nitriding treatment is preferably carried out in (a) a pure nitrogen gas, (b) a mixed gas containing 1–95 mol % of hydrogen, the balance being substantially nitrogen, or (c) a mixed gas containing 1–50 mol % of $NH_3$, the balance being substantially hydrogen. The nitriding atmosphere is preferably at about 0.2–10 atm, more preferably at about 0.5–5 atm. When it is less than 0.2 atm, the nitriding reaction is extremely slow. On the other hand, when it exceeds 10 atm, a high-pressure gas apparatus is needed, resulting in high production cost.

Preferable as the nitriding method for practical reasons is a gas-nitriding method comprising heating the mother alloy powder in the above nitriding atmosphere. The heating conditions of the gas-nitriding treatment are preferably 300–650° C.×0.1–30 hours, more preferably 400–550° C.×0.5–20 hours. When they are less than 300° C.×0.1 hours, nitriding does not fully proceed. On the other hand, when they are more than 650° C.×30 hours, an R-N phase and an Fe-M phase are rather formed, resulting in decrease in iHc.

(H) Other Steps

Depending on the composition of the nitride-type, rare earth magnet material, a heat treatment may be carried out at 300–600° C. for 0.5–50 hours in vacuum or in an inert gas atmosphere (excluding a nitrogen gas) after the nitriding treatment, to provide the nitride-type, rare earth magnet material with further improved iHc.

[3] Bonded Rare Earth Magnet

The nitride-type, rare earth magnet material powder thus produced is bonded with a binder resin to form an isotropic, bonded rare earth magnet.

(A) Powder of Nitride-type, Rare Earth Magnet Material

Because the nitride-type, rare earth magnet material powder has a relatively small surface area in an average particle size range of 10–300 μm, its oxidation can be suppressed, thereby controlling the oxygen content to 0.25 weight % or less, resulting in high iHc. The content of carbon, which is an element forming α-Fe, is preferably limited to 0.1 weight % or less.

(B) Binder

Usable as binders for the isotropic, bonded magnet of the present invention are resins, rubbers, or metals (alloys) having lower melting points than the Curie temperature of the nitride-type, rare earth magnet material. From the aspect of practical applications, thermosetting resins, thermoplastic resins or rubbers are preferable. Specific examples of usable binder resins include epoxy resins, polyimide resins, polyester resins, phenol resins, fluoroplastics, silicone resins, polyphenylene sulfide resins (PPS), etc.

When a compression-molding method is utilized, thermosetting resins are preferable, and liquid thermosetting resins are particularly suitable. Specific examples of preferable liquid thermosetting resins are liquid epoxy resins, for the reasons of low cost, easy handling and good heat resistance of the molded products.

(C) Molding Method

The molding method may be a compression-molding method, an injection-molding method, an extrusion-molding method, a rolling method in which a magnetic powder compound is caused to pass through a pair of rotating rollers to form sheet-shaped moldings, etc.

By using a thermosetting resin as a binder, and by subjecting its compound to a thermal curing treatment after molding, a bonded rare earth magnet having a density of more than 6.1 g/cm$^3$ can be obtained. The thermal curing conditions are preferably 100–200° C.×0.5–5 hours in the air or in an inert gas atmosphere. With less than 100° C.×0.5 hours, an enough thermal curing reaction does not take place. Also, with more than 200° C.×5 hours, the effects of the heat treatment are saturated. Particularly when the thermal curing is performed in an Ar gas atmosphere, the resultant bonded rare earth magnet preferably has an improved $(BH)_{max}$.

The present invention will be described in further detail referring to the following Examples without intention of limiting the present invention thereto.

EXAMPLE 1

Figure 4:
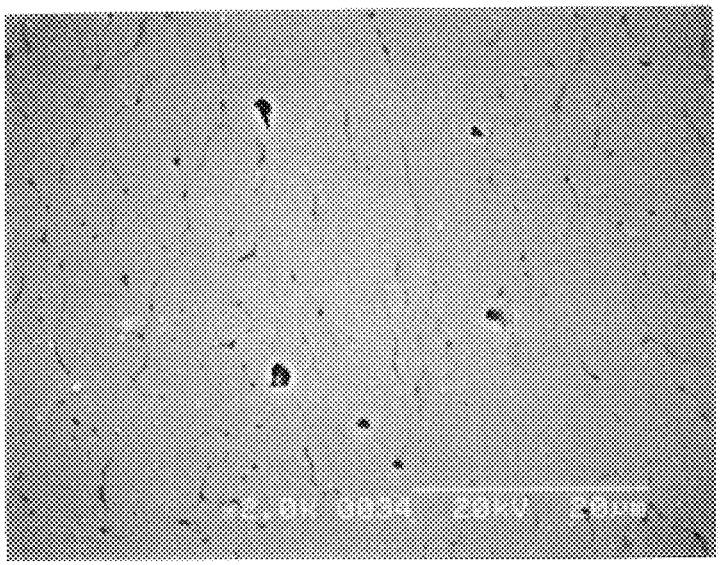
FIG. 4 is an electron microscopic photograph showing the structure of a thin mother alloy ribbon of a nitride-type, rare earth magnet material of No. 1 in EXAMPLE 1.

Sm, Fe, Ti and B each having a purity of 99.9% or more were formulated in such proportions as to obtain mother alloy compositions corresponding to the nitride-type, rare earth magnet material powders of Nos. 1–7 shown in Table 1, and melted in a high-frequency furnace in an argon gas atmosphere. The resultant mother alloy melt was poured into a gap between a pair of cooling copper rolls (diameter: 300 mm) of a twin-roll-type, strip caster to rapidly quench the melt at a peripheral speed of the cooling rolls of 1.0 m/second, thereby obtaining a thin mother alloy ribbon having a thickness of 200–300 μm. Among them, a photomicrograph of the cross section of the thin mother alloy ribbon of No. 1 is shown in FIG. 4. Though voids and crystal grain boundaries were observed in FIG. 4, it was confirmed that α-Fe was not formed. Each thin mother alloy ribbon was subjected to a hydrogenation/decomposition reaction treatment by heating at 680° C. for 1 hour in a hydrogen gas at 1 atm. It was then subjected to a dehydrogenation/recombination reaction treatment by heating at 800° C. for 15 hours in vacuum of $5\times10^{-2}$ to $8\times10^{-2}$ Torr. It was further pulverized to an average particle size $dp_{av}$ of 10–300 μm in an argon gas atmosphere by a jaw crusher and a disc mill. The measurement of a particle size dp was carried out by using a laser diffraction-type particle size distribution-measuring apparatus (HELOS. RODOS, available from Sympatec).

Each pulverized mother alloy powder was subjected to a nitriding treatment by heating at 450° C. for 10 hours in a nitriding gas ($NH_3$ +hydrogen) at 1 atm, and then cooled. It was then heat-treated at 400° C. for 30 minutes in an argon gas stream to obtain nitride-type, rare earth magnet material powders of Nos. 1–7 shown in Table 1.

Each of the resultant nitride-type, rare earth magnet material powders of Nos. 1–7 was measured with respect to an average crystal grain size $dc_{av}$ of a hard magnetic phase, an average particle size $dp_{av}$, saturation magnetization a and coercivity iHc at 25° C., and a temperature coefficient η of coercivity iHc between 25° C. and 100° C. The results are shown in Table 1.

Figure 8:
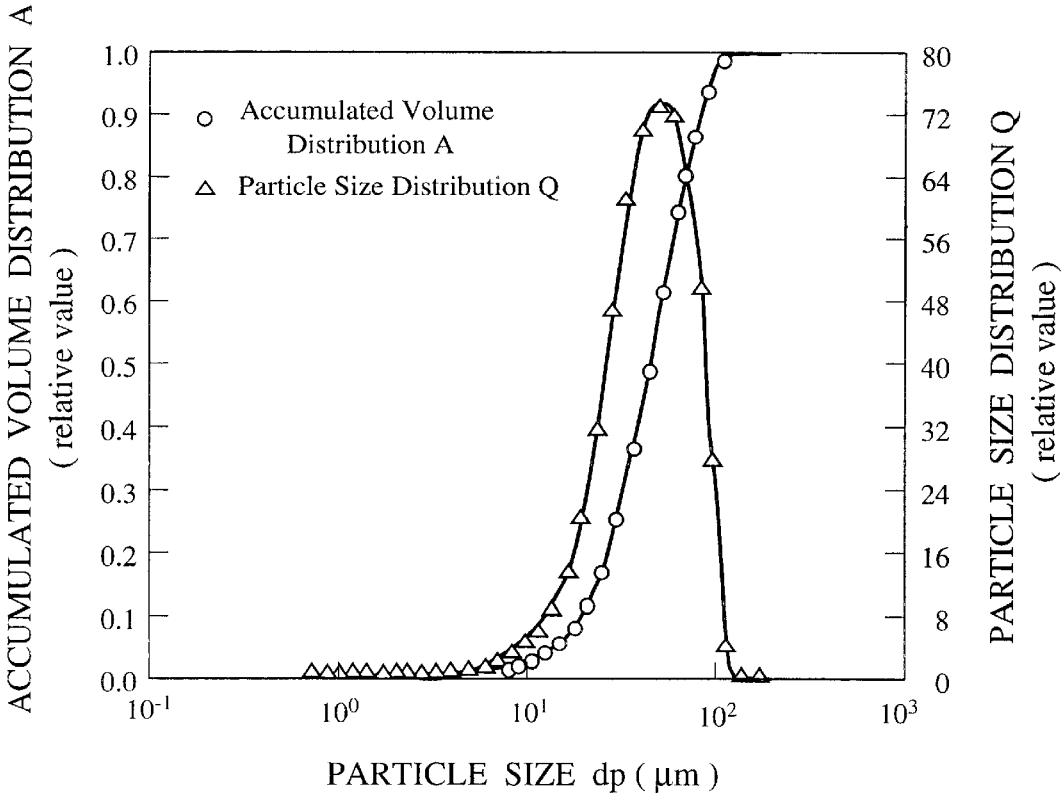
FIG. 8 is a graph showing a one-peak particle size distribution of the nitride-type, rare earth magnet material of No. 2 in EXAMPLE 1.

The particle size distribution (one-peak distribution) of the nitride-type, rare earth magnet material powder of No. 2 was measured by a laser diffraction-type particle size distribution-measuring apparatus (HELOS. RODOS). The results are shown in FIG. 8. In FIG. 8, the axis of abscissas represents a particle size dp (μm), the left axis of ordinates represents an accumulated volume distribution A, and the right axis of ordinates represents a particle size distribution defined by a differential equation: Q=d(A)/d(Indp). It was determined by Q whether or not the powder had a one-peak particle size distribution.

The coercivity iHc and the saturation magnetization a were measured by a method described below. First, each nitride-type, rare earth magnet material powder was mixed with paraffin wax at a weight ratio of 90:10, and sealed in a copper container of a vibration sample-type magnetometer (VSM). This container was heated to melt the paraffin wax and then cooled so that the nitride-type, rare earth magnet material powder was solidified by the paraffin wax. The container in this state was set in VSM to measure a and iHc at 25° C. in the air. The measured values of σ and iHc were used to calculate σ and iHc of the nitride-type, rare earth magnet material powder itself at 25° C. in the air. Next, σ and iHc were measured by VSM while heating at 100° C., and their measured values were used to calculate σ and iHc of the nitride-type, rare earth magnet material powder itself at 100° C. in the air. From these results, the temperature coefficient η of iHc between 25° C. and 100° C. was calculated by the equation:

$$\eta=[iHc(25^\circ\text{ C.})-iHc(100^\circ\text{ C.})]\div iHc(25^\circ\text{ C.})\times100\%.$$

Next, each nitride-type, rare earth magnet material powder of Nos. 1–7 was mixed with an acrylic resin powder and then compressed while heating to obtain a sample in which each nitride-type, rare earth magnet material powder was dispersed in a transparent acrylic resin. Each sample was ground such that the cross section of each magnet material powder was exposed, and electron diffraction patterns of the magnet material powder were obtained by a transmission electron microscope in arbitrarily selected five view fields. As a result, it was found that any nitride-type, rare earth magnet material powder was composed of a hard magnetic phase of an $R_2T_{17}$-type structure, whose main phase was substantially a hard magnetic phase constituted by a rhombohedral crystal having a $Th_2Zn_{17}$-type structure. Also, α-Fe was not observed.

Figure 3A:
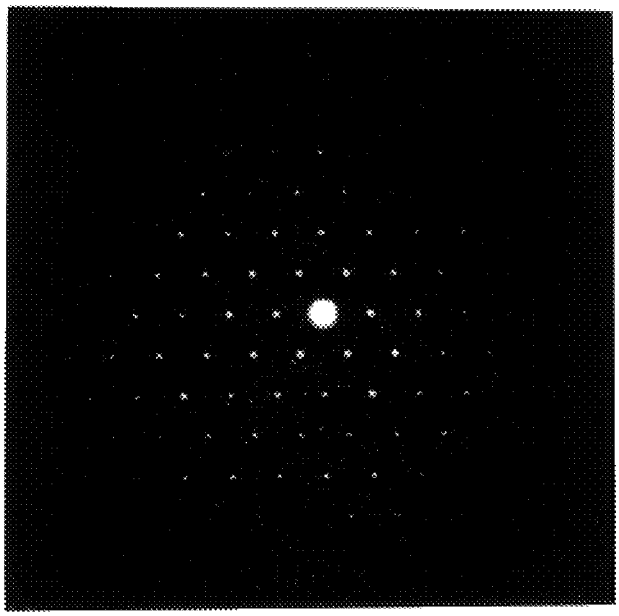
FIG. 3(*a*) is an electron diffraction pattern of a nitride-type, rare earth magnet material of No. 7 in EXAMPLE 1, indicating the existence of a hexagonal crystal of a $Th_2Ni_{17}$-type structure.
Figure 3B:
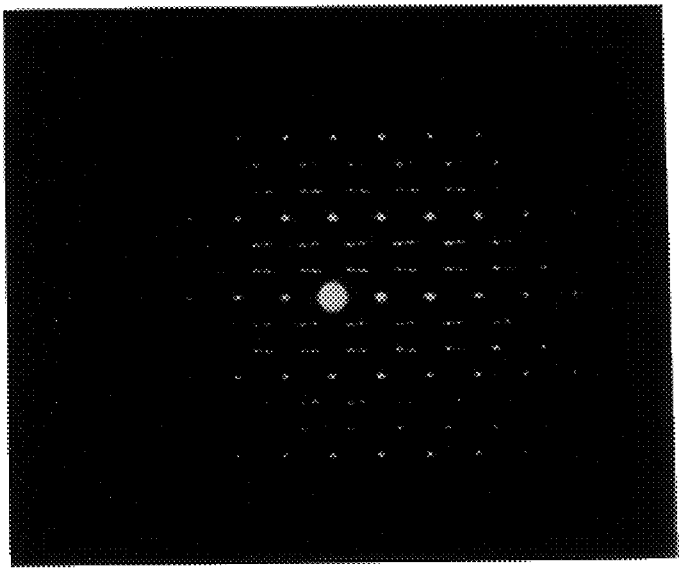

The nitride-type, rare earth magnet material powder of No. 7 was measured by using a transmission electron microscopy, to obtain an electron diffraction pattern shown in FIG. 3(*a*) indicating the existence of a hexagonal crystal of a $Th_2Ni_{17}$-type structure, and an electron diffraction pattern shown in FIG. 3(*b*) indicating the existence of a rhombohedral crystal of a $Th_2Zn_{17}$-type structure. FIG. 3(*a*) is an electron diffraction pattern taken by injecting an electron beam in a [001] direction, and FIG. 3(*b*) is an electron diffraction pattern taken by injecting an electron beam in a [100] direction.

As a result of considering the above results together with the observation results of X-ray diffraction and optical microscopy additionally carried out, it was confirmed that the nitride-type, rare earth magnet material powder of No. 7 was composed of a hard magnetic phase of a mixed crystal consisting of a rhombohedral crystal of a $Th_2Zn_{17}$-type structure and a hexagonal crystal of a $Th_2Ni_{17}$-type structure. Also, α-Fe was not observed.

Comparative Example 1

Nitride-type, rare earth magnet material powders of Nos. 11 and 12 were produced in the same manner as in EXAMPLE 1 except for changing the pulverization time by a disc mill in an argon gas atmosphere. The resultant nitride-type, rare earth magnet material powders had $dp_{av}$ of 2 μm and 400 μm, respectively. Each nitride-type, rare earth magnet material powder was evaluated in the same manner as in EXAMPLE 1. The results are shown in Table 1 as Nos. 11 and 12.

Comparative Example 2

Nitride-type, rare earth magnet material powders were produced in the same manner as in EXAMPLE 1 except for having the basic compositions containing no Ti (Nos. 21 and 22), the basic composition containing too small an amount of Ti (No. 23), or the basic composition containing too large an amount of Ti (No. 24). Each nitride-type, rare earth magnet material powder was evaluated in the same manner as in EXAMPLE 1. The results are shown in Table 1.

TABLE 1

| EX. NO. | No. | Powder* Composition (atomic %) | $dc_{av}$ (μm) | $dp_{av}$ (μm) | σ (emu/g) | iHc (kOe) | η (%/° C.) |
|---|---|---|---|---|---|---|---|
| EX. 1 | 1 | $Sm_{8.1}Fe_{bal.}Ti_{2.7}B_{2.0}N_{12.5}$ | 0.35 | 10 | 131 | 9.2 | −0.36 |
| | 2 | $Sm_{8.2}Fe_{bal.}Ti_{2.7}B_{2.0}N_{12.3}$ | 0.33 | 40 | 133 | 9.5 | −0.35 |

TABLE 1-continued

| EX. NO. | No. | Powder* Composition (atomic %) | $dc_{av}$ ($\mu$m) | $dp_{av}$ ($\mu$m) | σ (emu/g) | iHc (kOe) | η (%/° C.) |
|---|---|---|---|---|---|---|---|
| | 3 | $Sm_{8.3}Fe_{bal.}Ti_{2.8}B_{2.0}N_{12.8}$ | 0.35 | 80 | 130 | 9.8 | −0.34 |
| | 4 | $Sm_{8.2}Fe_{bal.}Ti_{2.7}B_{2.0}N_{12.4}$ | 0.38 | 150 | 132 | 10.3 | −0.32 |
| | 5 | $Sm_{8.1}Fe_{bal.}Ti_{2.8}B_{2.0}N_{12.1}$ | 0.34 | 300 | 131 | 9.9 | −0.34 |
| | 6 | $Sm_{8.2}Fe_{bal.}Ti_{0.5}B_{2.0}N_{12.3}$ | 0.38 | 80 | 134 | 9.0 | −0.37 |
| | 7 | $Sm_{8.2}Fe_{bal.}Ti_{10.0}B_{2.0}N_{12.3}$ | 0.37 | 81 | 120 | 9.2 | −0.36 |
| COMP. | 11 | $Sm_{8.1}Fe_{bal.}Ti_{2.7}B_{2.0}N_{12.4}$ | 0.36 | 2 | 101 | 4.2 | −0.54 |
| EX. 1 | 12 | $Sm_{8.2}Fe_{bal.}Ti_{2.7}B_{2.0}N_{12.3}$ | 0.35 | 400 | 103 | 4.5 | −0.52 |
| COMP. | 21 | $Sm_{8.3}Fe_{bal.}B_{2.0}N_{12.4}$ | 0.51 | 80 | 140 | 1.7 | −0.74 |
| EX. 2 | 22 | $Sm_{8.3}Fe_{bal.}B_{2.0}N_{12.8}$ | 0.52 | 160 | 139 | 1.4 | −0.74 |
| | 23 | $Sm_{8.2}Fe_{bal.}Ti_{0.2}B_{2.0}N_{12.2}$ | 0.48 | 80 | 137 | 2.0 | −0.70 |
| | 24 | $Sm_{8.2}Fe_{bal.}Ti_{15.2}B_{2.0}N_{13.2}$ | 0.54 | 82 | 101 | 1.1 | −0.76 |

Note:
Nitride-type, rare earth magnet material powder.

It is clear from Table 1 that any of Nos. 1–7 in EXAMPLE 1 had a hard magnetic phase having $dc_{av}$ of less than 0.4 $\mu$m, σ of 120 emu/g or more, iHc of 9 kOe or more, a temperature coefficient η of iHc of less than −0.40%/° C., indicating that they had good heat resistance. It is considered that these good magnetic properties are obtained by meeting the conditions that the Ti content is 0.5–10 atomic %, and $dp_{av}$= 10–300 $\mu$m.

On the other hand, both of Nos. 11 and 12 of COMPARATIVE EXAMPLE 1 were poor in σ, iHc and η, because the former was subjected to oxidation deterioration and the latter had a non-uniform nitrided structure.

In any of Nos. 21 and 22 containing no Ti, No. 23 containing too small an amount of Ti, and No. 24 containing too large an amount of Ti in COMPARATIVE EXAMPLE 2, coarse α-Fe particles having an average particle size of more than 1 $\mu$m were formed in more than 5% by average area ratio, and thus these nitride-type, rare earth magnet material powders had poor iHc and η.

Figure 5:
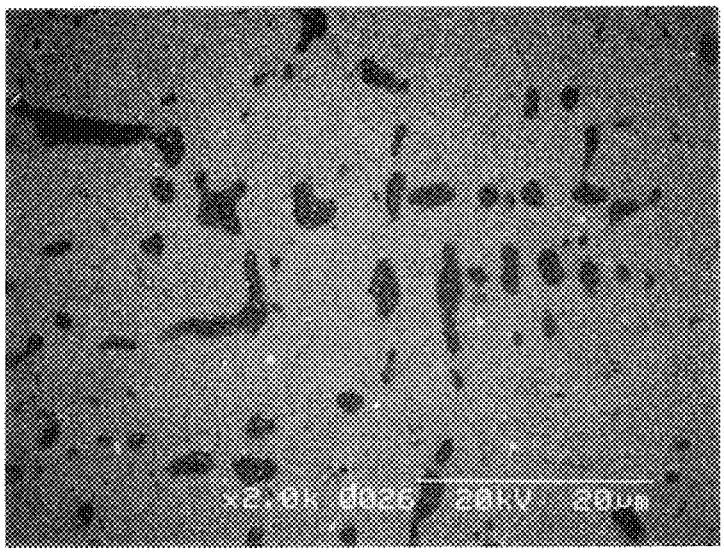
FIG. 5 is an electron microscopic photograph showing the structure of a thin mother alloy ribbon of a nitride-type, rare earth magnet material of No. 21 in COMPARATIVE EXAMPLE 2.

FIG. 5 is an electron microscopic photograph of a cross section of a thin mother alloy ribbon for the nitride-type, rare earth magnet material powder of No. 21 containing no Ti. In FIG. 5, black dendritic α-Fe having an average particle size of more than 1 $\mu$m was observed in more than 5% by average area ratio. It was also confirmed that α-Fe did not disappear by the hydrogenation/decomposition reaction, the dehydrogenation/recombination reaction and the nitriding reaction.

EXAMPLE 2

To observe the correlation of the B content and magnetic properties, component elements were formulated in such proportions as to provide basic compositions of Nos. 31–34 shown in Table 2, and nitride-type, rare earth magnet material powders were produced in the same manner as in EXAMPLE 1. Each of the resultant nitride-type, rare earth magnet material powders had $dp_{av}$ of 80 $\mu$m. Each nitride-type, rare earth magnet material powder was evaluated in the same manner as in EXAMPLE 1. The results are shown in Table 2 as Nos. 31–34.

Figure 2:
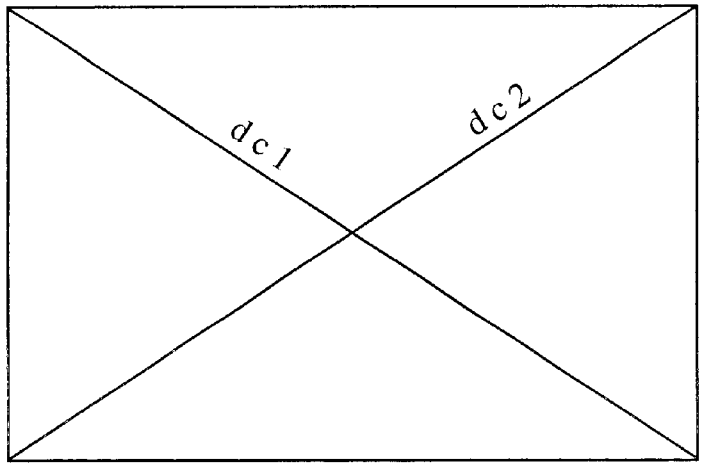
FIG. 2 is a schematic view explaining a method of measuring an average crystal grain size of the nitride-type, rare earth magnet material shown in FIG. 1.

A sample for measuring $dc_{av}$ was produced from the nitride-type, rare earth magnet material powder of No. 33, and its transmission electron microscopic photograph was taken in arbitrarily selected five view fields. FIG. 1 shows one of the resultant TEM photographs, and FIG. 2 explains how $dc_{av}$ was determined with respect to the nitride-type, rare earth magnet material powder of FIG. 1. Diagonal lines were drawn in each TEM photograph in five view fields. Line portions occupied by the crystal grain particles on each diagonal line were summed with respect to length, and the resultant total length was divided by the number of the crystal grain particles to determine $dc_1$ and $dc_2$. As shown in FIG. 2, $dc_1$ was 0.16 $\mu$m, and $dc_2$ was 0.15 $\mu$m. Averaging $dc_1$ and $dc_2$ determined in all view fields, $dc_{av}$ was 0.16 $\mu$m.

Comparative Example 3

As shown in Table 2, nitride-type, rare earth magnet material powders were produced in the same manner as in EXAMPLE 1 except for having the basic composition containing too small an amount of B (No. 41), or the basic composition containing too large an amount of B (No. 42). Each nitride-type, rare earth magnet material powder was evaluated in the same manner as in EXAMPLE 1. The results are shown in Table 2 as Nos. 41 and 42.

TABLE 2

| Ex. No. | No. | Powder* Composition (atomic %) | $dc_{av}$ ($\mu$m) | σ (emu/g) | iHc (kOe) | η (%/° C.) |
|---|---|---|---|---|---|---|
| EX. 2 | 31 | $Sm_{8.2}Fe_{bal.}B_{0.1}Ti_{2.7}N_{12.9}$ | 0.33 | 129 | 9.2 | −0.36 |
| | 32 | $Sm_{8.3}Fe_{bal.}B_{1.0}Ti_{2.8}N_{12.7}$ | 0.28 | 127 | 10.2 | −0.32 |
| | 33 | $Sm_{8.2}Fe_{bal.}B_{3.0}Ti_{2.9}N_{12.5}$ | 0.16 | 126 | 10.3 | −0.32 |
| | 34 | $Sm_{8.1}Fe_{bal.}B_{4.0}Ti_{2.8}N_{12.2}$ | 0.01 | 124 | 10.5 | −0.31 |
| COMP. | 41 | $Sm_{8.2}Fe_{bal.}B_{0.03}Ti_{2.7}N_{12.2}$ | 0.55 | 130 | 3.8 | −0.59 |
| EX. 3 | 42 | $Sm_{8.2}Fe_{bal.}B_{10.0}Ti_{2.8}N_{12.2}$ | 0.58 | 115 | 2.2 | −0.68 |

Note: Nitride-type, rare earth magnet material powder.

It was found from Nos. 31–34 in Table 2 that when the B content was 0.1–4 atomic %, $dc_{av}$=0.01–0.33 $\mu$m, resulting in good σ, iHc and η. A phase generating magnetic properties in the nitride-type, rare earth magnet material powders of Nos. 31–34 was substantially composed of a rhombohedral crystal of a $Th_2Zn_{17}$-type structure, free from α-Fe.

On the other hand, in any of the nitride-type, rare earth magnet material powders of Nos. 41 and 42 in COMPARATIVE EXAMPLE 3, coarse α-Fe having an average particle size of more than 1 $\mu$m was formed in more than 5% by average area ratio, and thus these nitride-type, rare earth magnet material powders had poor iHc and η.

Figure 6:
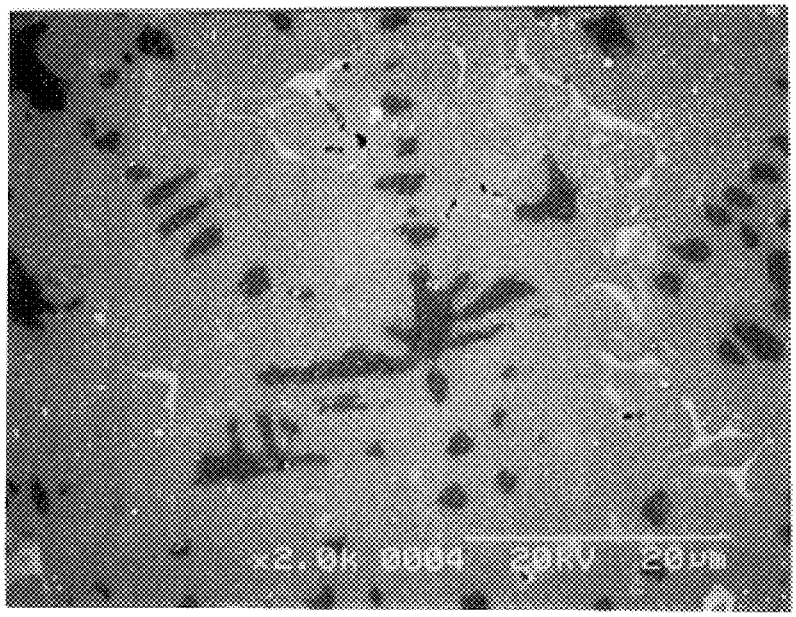
FIG. 6 is an electron microscopic photograph showing the structure of a thin mother alloy ribbon of No. 41 in COMPARATIVE EXAMPLE 3.

FIG. 6 is a photograph showing a cross section of a thin mother alloy ribbon of No. 41 containing too small an amount of B. It was confirmed from FIG. 6 that coarse, black dendritic α-Fe having an average particle size of more than 1 $\mu$m was formed in more than 5% by average area ratio, and that α-Fe did not disappear by the nitriding reaction.

EXAMPLE 3

Comparative Example 4

To evaluate magnetic properties with varied types and contents of R, varied contents of nitrogen, and varied types and contents of M, and with Fe partially substituted by Co and/or Ni, nitride-type, rare earth magnet material powders were produced in the same manner as in EXAMPLE 1 except for having the basic compositions shown in Table 3. Each nitride-type, rare earth magnet material powder was evaluated in the same manner as in EXAMPLE 1. The results are shown in Table 3.

TABLE 3

| Ex. No. | No. | Powder* Composition (atomic %) | $dc_{av}$ ($\mu$m) | σ (emu/g) | iHc (kOe) | η (%/° C.) |
|---|---|---|---|---|---|---|
| EX. 3 | 51 | $Sm_{6.0}Fe_{bal.}B_{2.0}Ti_{2.7}N_{12.6}$ | 0.35 | 134 | 8.4 | −0.39 |
| | 52 | $Sm_{15.0}Fe_{bal.}B_{2.0}Ti_{2.7}N_{12.8}$ | 0.36 | 128 | 10.4 | −0.32 |
| | 53 | $Sm_{5.2}Pr_{3.1}Fe_{bal.}B_{2.0}Ti_{2.8}N_{12.8}$ | 0.34 | 128 | 9.1 | −0.36 |
| | 54 | $Sm_{8.3}Fe_{bal.}B_{2.0}Ti_{2.8}N_{4.0}$ | 0.34 | 123 | 9.1 | −0.36 |
| | 55 | $Sm_{8.2}Fe_{bal.}B_{2.0}Ti_{2.7}N_{30.0}$ | 0.35 | 122 | 9.2 | −0.36 |
| | 56 | $Sm_{9.3}Fe_{bal.}Co_{0.5}B_{1.0}Ti_{3.2}N_{12.3}$ | 0.33 | 125 | 8.8 | −0.32 |
| | 57 | $Sm_{9.2}Fe_{bal.}Co_{30.0}B_{1.0}Ti_{3.2}N_{12.9}$ | 0.32 | 122 | 7.9 | −0.28 |
| | 58 | $Sm_{9.3}Fe_{bal.}Ni_{1.0}B_{2.0}Ti_{3.2}N_{12.3}$ | 0.34 | 127 | 8.1 | −0.32 |
| | 59 | $Sm_{9.3}Fe_{bal.}Co_{20}Ni_{10}B_{2.0}Ti_{3.1}N_{10.3}$ | 0.30 | 121 | 8.0 | −0.28 |
| | 60 | $Sm_{9.2}Fe_{bal.}B_{1.0}Ti_{0.5}Cr_{3.0}N_{10.3}$ | 0.34 | 126 | 8.1 | −0.40 |
| | 61 | $Sm_{9.2}Fe_{bal.}B_{1.0}Ti_{2.0}Cr_{2.0}N_{10.3}$ | 0.33 | 125 | 8.0 | −0.40 |
| COMP. | 71 | $Sm_{4.5}Fe_{bal.}B_{2.0}Ti_{2.7}N_{10.0}$ | 0.55 | 130 | 2.9 | −0.60 |
| EX. 4 | 72 | $Sm_{21.3}Fe_{bal.}B_{2.0}Ti_{2.7}N_{15.2}$ | 0.52 | 102 | 2.2 | −0.68 |
| | 73 | $Sm_{3.0}Pr_{4.3}Fe_{bal.}B_{2.0}Ti_{2.8}N_{12.5}$ | 0.58 | 129 | 3.1 | −0.58 |
| | 74 | $Sm_{8.2}Fe_{bal.}B_{2.0}Ti_{2.8}N_{2.0}$ | 0.55 | 94 | 2.1 | −0.68 |
| | 75 | $Sm_{8.2}Fe_{bal.}B_{2.0}Ti_{2.7}N_{35.0}$ | 0.54 | 108 | 2.2 | −0.68 |

Note: Nitride-type, rare earth magnet material powder.

It was confirmed from Table 3 that any of the nitride-type, rare earth magnet material powders of EXAMPLE 3 had a structure composed of a fine hard magnetic phase of an $R_2T_{17}$-type structure free from α-Fe.

It is clear from Nos. 51–53 in EXAMPLE 3 and Nos. 71–73 in COMPARATIVE EXAMPLE 4 that when the percentage of Sm in the R components is 50 atomic % or more, and when the R components are 6–15 atomic %, good σ, iHc and η are obtained.

It is clear from Nos. 54 and 55 in EXAMPLE 3 and Nos. 74 and 75 in COMPARATIVE EXAMPLE 4 that when the nitrogen content is 4–30 atomic %, good σ, iHc and η are improved.

It is clear from Nos. 56–59 in EXAMPLE 3 that when 0.5–30 atomic % of Fe is substituted by Co and/or Ni, η is improved.

It is clear from Nos. 60 and 61 in EXAMPLE 3 that when the Ti content in M is 0.5 atomic % or more per 100 atomic % of the overall composition, good σ, iHc and η are obtained.

EXAMPLE 4

Sm, Fe, Ti and B each having a purity of 99.9% or more were formulated to a composition corresponding to the basic composition described below, and melted in a high-frequency furnace in an argon gas atmosphere. The resultant mother alloy melt was rapidly quenched by cooling rolls at a peripheral speed of 9.5 m/second, thereby obtaining a thin mother alloy ribbon having a thickness of 250–300 $\mu$m. This thin mother alloy ribbon was placed in an atmosphere-controlled heat treatment furnace, and repeated the step of heating to 500° C. while supplying a hydrogen gas at 1 atm to have the alloy to absorb hydrogen and the step of evacuating to carry out dehydrogenation, thereby coarsely pulverizing the alloy to an average particle size of 100 $\mu$m.

The resultant powder was subjected to a hydrogenation/decomposition reaction treatment under the heating conditions shown in Table 4 at a hydrogen gas pressure of 1 atm. It was then subjected to a dehydrogenation/recombination reaction treatment under the heating conditions shown in Table 4 in vacuum of $5\times10^{-2}$ to $8\times10^{-2}$ Torr. Thereafter, it was nitrided by heating at 460° C. for 7 hours in a nitriding gas ($NH_3$+hydrogen) stream at 1 atm in a different atmosphere-controlled heat treatment furnace, and then cooled to room temperature. It was then heat-treated at 400° C. for 30 minutes in an argon gas stream and then cooled to room temperature.

The resultant nitride-type, rare earth magnet material powder thus produced had a basic composition of $Sm_{9.2}Fe_{bal.}B_{1.0}Ti_{6.0}N_{12.3}$ by atomic %, and a structure substantially consisting of an $R_2T_{17}$-type, hard magnetic phase free from α-Fe. Each nitride-type, rare earth magnet material powder was evaluated with respect to $dc_{av}$, σ and iHc in the same manner as in EXAMPLE 1. The results are shown in Table 4.

Comparative Example 5

Nitride-type, rare earth magnet material powders were produced and their magnetic properties were evaluated in the same manner as in EXAMPLE 4 except for changing the heating conditions for a hydrogenation/decomposition reaction and a dehydrogenation/recombination reaction to those shown in Table 4. The results are shown in Table 4.

TABLE 4

| | | | Hydrogenation/ Decomposition | | Dehydro-genation/ Recombination | | Magnetic Properties of Nitride Powder | |
|---|---|---|---|---|---|---|---|---|
| EX. NO. | No. | $dc_{av}$ ($\mu$m) | Tem. (° C.) | Time (hour) | Tem. (° C.) | Time (hour) | σ (emu/g) | iHc (kOe) |
| EX. 4 | 81 | 0.21 | 675 | 5 | 800 | 2 | 120 | 10.3 |
| | 82 | 0.23 | 800 | 5 | 800 | 2 | 122 | 9.8 |
| | 83 | 0.36 | 900 | 5 | 800 | 2 | 125 | 8.4 |
| | 84 | 0.20 | 675 | 0.5 | 800 | 2 | 121 | 10.1 |
| | 85 | 0.39 | 900 | 8 | 800 | 2 | 124 | 8.1 |
| | 86 | 0.33 | 700 | 2 | 700 | 0.5 | 124 | 8.8 |
| | 87 | 0.30 | 700 | 2 | 800 | 2 | 120 | 9.0 |
| | 88 | 0.39 | 700 | 2 | 900 | 10 | 125 | 8.2 |
| COM. | 91 | 2.20 | 650 | 0.5 | 800 | 2 | 100 | 2.5 |
| EX. 5 | 92 | 1.45 | 950 | 8 | 800 | 2 | 128 | 3.1 |
| | 93 | 2.10 | 800 | 5 | 650 | 0.5 | 103 | 2.5 |
| | 94 | 1.65 | 800 | 5 | 950 | 10 | 129 | 2.9 |

It has been confirmed from Table 4 that by setting the heating conditions for a hydrogenation/decomposition reaction at 675–900° C.×0.5–8 hours and the heating conditions for a dehydrogenation/recombination reaction at 700–900° C.×0.5–10 hours as in EXAMPLE 4, the resultant nitride-type, rare earth magnet material powder can be provided with $dc_{av}$ of less than 1 μm and high σ and iHc.

On the other hand, when the temperature of the hydrogenation/decomposition reaction was too low (No. 91), when the temperature of the hydrogenation/decomposition reaction was too high (No. 92), when the temperature of the dehydrogenation/recombination reaction was too low (No. 93), or when the temperature of the dehydrogenation/recombination reaction was too high (No. 94), $dc_{av}$ was more than 1 μm.

EXAMPLE 5

To evaluate the magnetic properties of bonded rare earth magnets, 98 weight % of each nitride-type, rare earth magnet material powder shown in Table 5, which was substantially composed of an $R_2T_{17}$-type, hard magnetic phase having $dc_{av}$=0.2–0.3 μm and free from α-Fe, was blended with 2 weight % of an epoxy resin to prepare compounds. Incidentally, each nitride-type, rare earth magnet material powder was produced in the same manner as in EXAMPLE 1, a peripheral speed of rolls being 1 m/second in the production of its thin mother alloy ribbon having a thickness of 200–500 μm. Each compound was compression-molded at a press pressure of 10 ton/$cm_2$ and subjected to a thermal setting treatment at 140° C. for 1 hour in the air, to produce an isotropic, bonded magnet.

With respect to each bonded rare earth magnet, iHc and $(BH)_{max}$ measured at 25° C. and at a magnetizing field intensity of 25 kOe, a temperature coefficient η' of iHc between 25° C. and 100° C., and a density ρ are shown in Table 5. Measuring iHc at both 25° C. and 100° C. and at a magnetizing field intensity of 25 kOe, the temperature coefficient η' of iHc of each isotropic, bonded magnet was determined by the following equation:

$$\eta' = [iHc(25^\circ\text{ C.})\text{ of bonded magnet} - iHc(100^\circ\text{ C.})\text{ of bonded magnet}] \div [iHc(25^\circ\text{ C.})\text{ of bonded magnet}] \times 100\%.$$

Comparative Example 6

Mother alloy melts having compositions corresponding to the basic compositions of COMPARATIVE EXAMPLE 6 shown in Table 5 were rapidly quenched by a melt-quenching method at a peripheral speed of cooling rolls of 45 mm/second. The resultant thin ribbons having a thickness of about 30 μm were formed into nitride-type, rare earth magnet material powders in the same manner as in EXAMPLE 1. Each nitride-type, rare earth magnet material powder was formed into an isotropic, bonded magnet in the same manner as in EXAMPLE 5. The $dp_{av}$ and magnetic properties of each isotropic, bonded magnet are shown in Table 5.

TABLE 5

| EX. NO. | No. | Powder* Composition (atomic %) | $dp_{av}$ (μm) | iHc (kOe) | $(BH)_{max}$ (MGOe) | η' (%/° C.) | ρ (g/$cm^3$) |
|---|---|---|---|---|---|---|---|
| EX. 5 | 101 | $Sm_{8.9}Fe_{bal.}B_{1.0}Ti_{2.7}N_{12.7}$ | 10 | 9.2 | 8.8 | −0.38 | 6.16 |
| | 102 | $Sm_{8.9}Fe_{bal.}B_{1.0}Ti_{6.2}N_{12.4}$ | 80 | 9.3 | 8.1 | −0.37 | 6.21 |
| | 103 | $Sm_{8.8}Fe_{bal.}B_{1.0}Ti_{3.0}Zr_{0.5}N_{12.8}$ | 150 | 9.6 | 8.4 | −0.36 | 6.24 |
| | 104 | $Sm_{8.7}Fe_{bal.}B_{1.0}Ti_{3.0}V_{0.5}N_{11.3}$ | 300 | 9.5 | 8.3 | −0.36 | 6.22 |
| COMP. | 111 | $Sm_{8.9}Fe_{bal.}B_{1.0}Ti_{2.7}N_{12.7}$ | 85 | 9.2 | 7.9 | −0.39 | 5.77 |
| EX. 6 | 112 | $Sm_{8.9}Fe_{bal.}B_{1.0}Ti_{6.3}N_{12.5}$ | 160 | 9.2 | 7.3 | −0.39 | 5.86 |

Note:
Nitride-type, rare earth magnet material powder.

It is clear from Table 5 that any of the isotropic, bonded magnets of EXAMPLE 5 had a density of more than 6.1 g/cm and as high $(BH)_{max}$ as 8.0 MGOe or more. The reason therefor is considered that because the nitride-type, rare earth magnet material powder used in EXAMPLE 5 was produced by nitriding powder of a mother alloy rapidly quenched at a relatively low peripheral speed of rolls within a range of 0.05–10 m/second, it was in a rounder particle shape than that of COMPARATIVE EXAMPLE 6, thereby achieving a higher filling density.

EXAMPLE 6

Comparative Example 7

To evaluate magnetizability, Sm, La, Fe, Ti and B each having a purity of 99.9% or more were formulated to a mother alloy composition corresponding to each basic composition shown in Table 6, and melted in a high-frequency furnace in an argon gas atmosphere. The resultant mother alloy melt was poured into a gap between a pair of cooling copper rolls (diameter: 300 mm, peripheral speed: 0.5 m/second) of a twin-roll-type, strip caster to rapidly quench the melt to form a thin mother alloy ribbon having a thickness of 250–300 μm. In each thin mother alloy ribbon thus produced, α-Fe was not formed.

Each thin mother alloy ribbon was subjected to a hydrogenation/decomposition reaction treatment by heating at 675° C. for 1 hour in a hydrogen gas at 1 atm and then to a dehydrogenation/recombination reaction treatment by heating at 790° C. for 15 hours in vacuum of $3\times10^{-2}$ to $6\times10^{-2}$ Torr. Each treated thin mother alloy ribbon was pulverized to an average particle size $dp_{av}$ of about 80 μm in an argon gas atmosphere. Each resultant mother alloy powder was subjected to a nitriding treatment by heating at 440° C. for 10 hours in a nitriding gas ($NH_3$+hydrogen) at 1 atm, and then cooled. It was then heat-treated at 400° C. for 30 minutes in an argon gas stream to obtain each nitride-type, rare earth magnet material powder having a composition shown in Table 6.

Each nitride-type, rare earth magnet material powder was formed into an isotropic, bonded magnet and evaluated with respect to $(BH)_{max}$ and Hk at 25° C. and at a magnetizing field intensity of 25 kOe in the same manner as in EXAMPLE 5. The results are shown in Table 6.

Figure 7A:
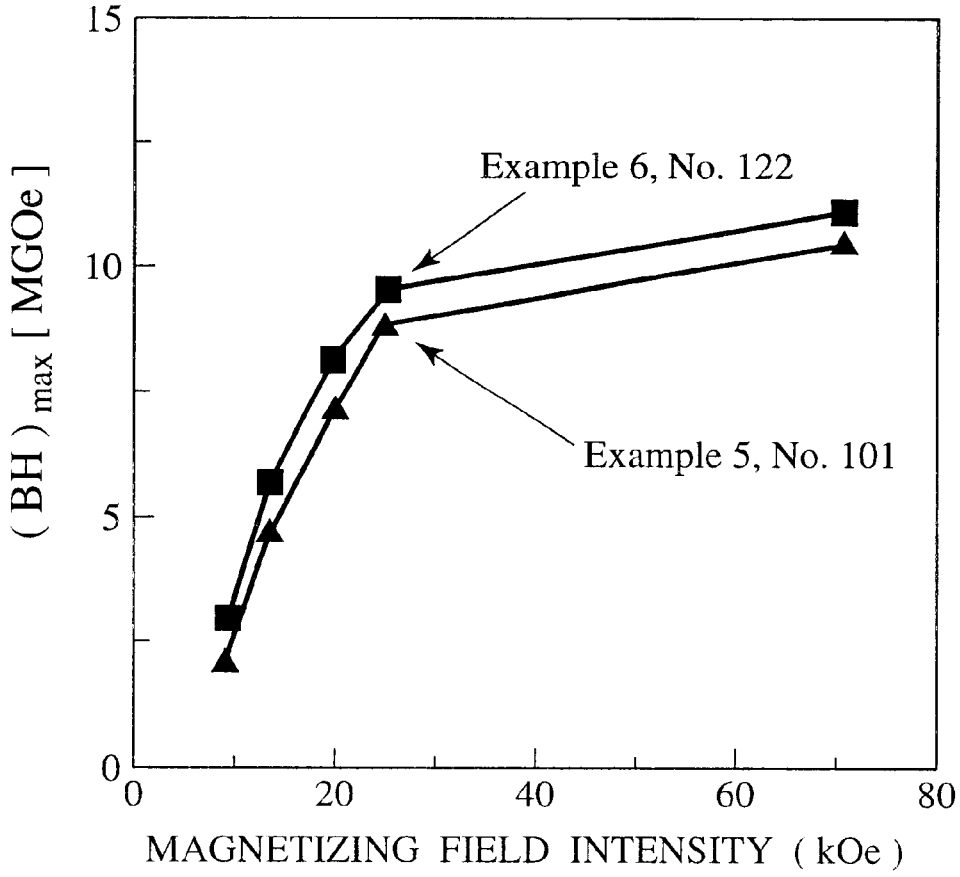
FIG. 7(*a*) is a graph showing the relation between the intensity of a magnetizing field and $(BH)_{max}$ in isotropic, bonded magnets of No. 101 in EXAMPLE 5 and No. 122 in EXAMPLE 6.
Figure 7B:
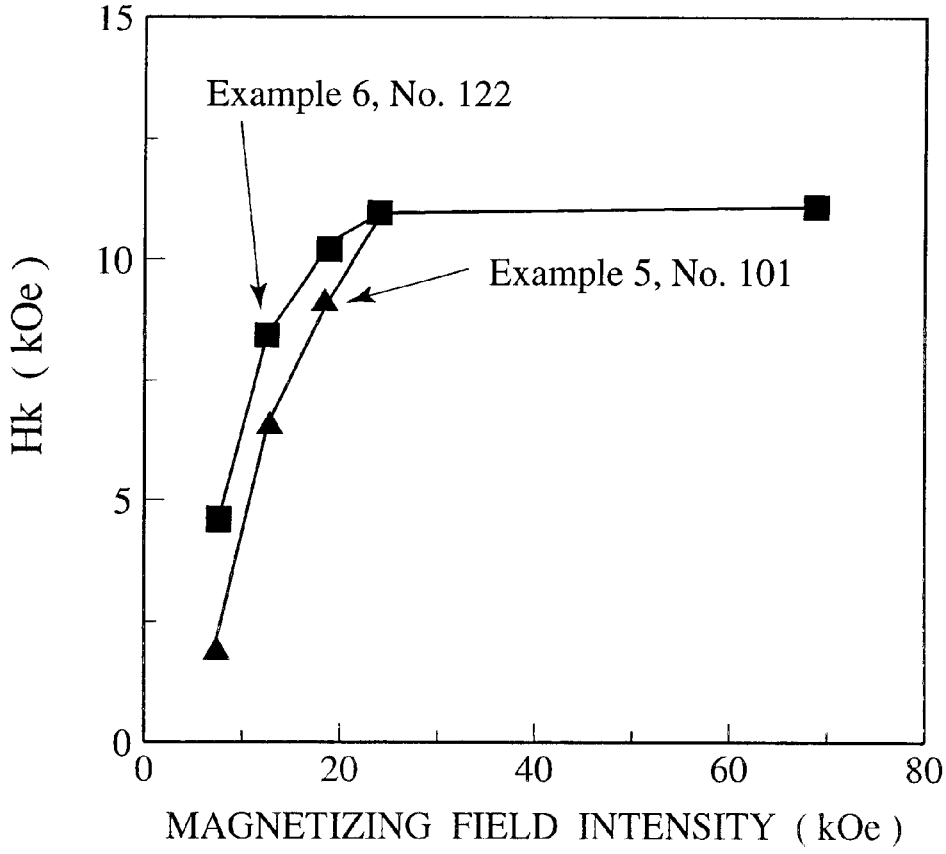

With respect to the isotropic, bonded magnets of No. 122 (EXAMPLE 6) in Table 6 and No. 101 (EXAMPLE 5) in Table 5, $(BH)_{max}$ relative to a magnetizing field intensity is shown in FIG. 7(*a*), and Hk relative to a magnetizing field intensity is shown in FIG. 7(*b*).

TABLE 6

| EX. NO. | No. | Powder* Composition (atomic %) | $(BH)_{max}$ (MGOe) | Hk (kOe) |
|---|---|---|---|---|
| EX. 6 | 121 | $Sm_{9.24}La_{0.05}Fe_{bal.}B_{1.0}Ti_{2.7}N_{12.7}$ | 8.9 | 5.8 |
| | 122 | $Sm_{8.98}La_{0.32}Fe_{bal.}B_{1.0}Ti_{2.7}N_{13.0}$ | 9.6 | 6.4 |
| | 123 | $Sm_{8.30}La_{1.0}Fe_{bal.}B_{1.0}Ti_{2.7}N_{12.8}$ | 9.4 | 6.0 |
| COMP. | 131 | $Sm_{9.29}La_{0.02}Fe_{bal.}B_{1.0}Ti_{2.7}N_{12.8}$ | 8.8 | 5.7 |
| EX. 7 | 132 | $Sm_{7.80}La_{1.51}Fe_{bal.}B_{1.0}Ti_{2.7}N_{12.9}$ | 8.8 | 5.5 |

Note: Nitride-type, rare earth magnet material powder.

It is clear from Table 6 that at the La content of 0.05–1 atomic %, $(BH)_{max}$ and Hk are improved when magnetized at 25 kOe.

EXAMPLE 7

Comparative Example 8

Sm, Fe and M elements each having a purity of 99.9% or more were formulated to a mother alloy composition corresponding to each basic composition shown in Table 7, and melted in a high-frequency furnace to obtain a mother alloy ingot having a total weight of 30 kg. After carrying out a homogenizing heat treatment at 1100° C. for 10 hours in an argon gas atmosphere, each mother alloy ingot was pulverized to $dp_{av}$=200–210 μm in an argon gas atmosphere. Each resultant mother alloy powder was subjected to a hydrogenation/decomposition reaction treatment by heating at 680° C. for 1 hour in a hydrogen gas at 1 atm and then to a dehydrogenation/recombination reaction treatment by heating at 800° C. for 1 hours in vacuum of $5\times10^{-2}$ to $8\times10^{-2}$ Torr.

The mother alloy powder thus treated was further pulverized to an average particle size $dp_{av}$ of 80–85 μm in an argon gas atmosphere by a jaw crusher and a disc mill. Each pulverized mother alloy powder was subjected to a nitriding treatment by heating at 440° C. for 10 hours in a nitriding gas ($NH_3$+hydrogen) at 1 atm, and then cooled. It was then heat-treated at 400° C. for 30 minutes in an argon gas stream to obtain each nitride-type, rare earth magnet material powder shown in Table 7. Each nitride-type, rare earth magnet material powder was composed of an $R_2T_{17}$-type, hard magnetic phase having $dc_{av}$=0.4–0.5 μm, free from α-Fe.

Each nitride-type, rare earth magnet material powder was formed into an isotropic, bonded magnet and evaluated with respect to magnetic properties in the same manner as in EXAMPLE 5. The results are shown in Table 7.

TABLE 7

| EX. NO. | No. | Powder* Composition (atomic %) | iHc (kOe) | $(BH)_{max}$ (MGOe) | η (%/° C.) | ρ (g/cm³) |
|---|---|---|---|---|---|---|
| EX. 7 | 141 | $Sm_{8.9}Fe_{bal.}Ti_{0.5}N_{12.6}$ | 9.0 | 8.9 | −0.39 | 6.24 |
| | 142 | $Sm_{8.9}Fe_{bal.}Ti_{2.7}N_{12.5}$ | 9.1 | 8.9 | −0.38 | 6.22 |
| | 143 | $Sm_{8.8}Fe_{bal.}Ti_{10.0}N_{12.8}$ | 9.2 | 8.0 | −0.37 | 6.23 |
| | 144 | $Sm_{8.7}Fe_{bal.}V_{2.6}N_{12.6}$ | 9.0 | 8.5 | −0.39 | 6.22 |
| | 145 | $Sm_{8.7}Fe_{bal.}Zr_{2.6}N_{12.5}$ | 9.1 | 8.5 | −0.38 | 6.24 |
| | 146 | $Sm_{8.7}Fe_{bal.}Mn_{2.7}N_{12.6}$ | 8.9 | 8.5 | −0.39 | 6.22 |
| | 147 | $Sm_{8.7}Fe_{bal.}Al_{2.7}N_{12.5}$ | 8.8 | 8.4 | −0.39 | 6.22 |
| | 148 | $Sm_{8.7}Fe_{bal.}Cu_{2.6}N_{12.6}$ | 8.9 | 8.4 | −0.39 | 6.24 |
| | 149 | $Sm_{8.8}Fe_{bal.}Ga_{2.6}N_{12.7}$ | 9.0 | 8.5 | −0.39 | 6.23 |
| | 150 | $Sm_{8.7}Fe_{bal.}Nb_{2.6}N_{12.8}$ | 9.2 | 8.4 | −0.38 | 6.23 |
| | 151 | $Sm_{8.7}Fe_{bal.}Mo_{2.6}N_{12.6}$ | 9.1 | 8.4 | −0.38 | 6.23 |
| | 152 | $Sm_{8.6}Fe_{bal.}Hf_{2.7}N_{12.6}$ | 9.1 | 8.4 | −0.38 | 6.23 |
| | 153 | $Sm_{8.7}Fe_{bal.}Ta_{2.6}N_{12.8}$ | 9.2 | 8.4 | −0.38 | 6.23 |
| | 154 | $Sm_{8.7}Fe_{bal.}W_{2.6}N_{12.6}$ | 9.0 | 8.3 | −0.39 | 6.23 |

TABLE 7-continued

| EX. NO. | No. | Powder* Composition (atomic %) | iHc (kOe) | $(BH)_{max}$ (MGOe) | η (%/° C.) | ρ (g/cm³) |
|---|---|---|---|---|---|---|
| | 155 | $Sm_{8.8}Fe_{bal.}Zn_{2.7}N_{12.6}$ | 8.9 | 8.4 | −0.39 | 6.23 |
| COMP. | 161 | $Sm_{8.9}Fe_{bal.}Ti_{0.2}N_{12.7}$ | 2.0 | 2.3 | −0.73 | 6.21 |
| EX. 8 | 162 | $Sm_{8.9}Fe_{bal.}Ti_{15.6}N_{12.5}$ | 1.1 | 1.4 | −0.79 | 6.22 |

Note: Nitride-type, rare earth magnet material powder.

It is clear from Nos. 141–143 in EXAMPLE 7 and Nos. 161 and 162 in COMPARATIVE EXAMPLE 8 shown in Table 7 that when the Ti content is 0.5–10 atomic %, high iHc, $(BH)_{max}$ and η' can be obtained. It is further clear from Nos. 144–155 in Table 7 that high iHc, $(BH)_{max}$ and η can be obtained also when an M element other than Ti is contained in a proper amount.

EXAMPLE 8

Comparative Example 9

Sm, La, Fe and Ti each having a purity of 99.9% or more were formulated to a mother alloy composition corresponding to each basic composition shown in Table 8, and melted in a high-frequency furnace in an argon gas atmosphere to obtain a mother alloy ingot having a total weight of 20 kg. The resultant mother alloy ingots were formed into nitride-type, rare earth magnet material powders in the same manner as in EXAMPLE 7, which were then formed into isotropic, bonded magnets to evaluate their magnetizability. The results are shown in Table 8.

TABLE 8

| EX. NO. | No. | Powder* Composition (atomic %) | $(BH)_{max}$ (MGOe) | Hk (kOe) |
|---|---|---|---|---|
| EX. 8 | 171 | $Sm_{9.15}La_{0.05}Fe_{bal.}Ti_{2.7}N_{12.8}$ | 9.0 | 5.7 |
| | 172 | $Sm_{8.88}La_{0.31}Fe_{bal.}Ti_{2.7}N_{13.1}$ | 9.7 | 6.3 |
| | 173 | $Sm_{8.21}La_{1.0}Fe_{bal.}Ti_{2.7}N_{12.8}$ | 9.5 | 5.9 |
| COMP. | 181 | $Sm_{9.18}La_{0.02}Fe_{bal.}Ti_{2.7}N_{12.8}$ | 8.9 | 5.6 |
| EX. 9 | 182 | $Sm_{7.71}La_{1.55}Fe_{bal.}Ti_{2.7}N_{12.8}$ | 8.8 | 5.4 |

Note: Nitride-type, rare earth magnet material powder.

It is clear from Table 8 that even when B is not contained, the magnetizability is improved by the addition of La.

It should be noted that the above-described production method of the nitride-type, rare earth magnet material of the present invention is not restrictive. For instance, rare earth oxides may be used as starting materials for rare earth elements. In this case, rare earth oxides and other basic component elements are formulated to a mother alloy composition corresponding to the basic composition of the present invention, and the resultant mixture is mixed with metallic Ca in an amount necessary to reduce the rare earth oxides. The resultant mixture is heated, for instance at 1200° C. for 4 hours, in an inert gas atmosphere containing no nitrogen, thereby completely reducing the rare earth oxides to form a reaction product comprising an R—T—M(—B) mother alloy and CaO. This reaction product is washed with an aqueous washing medium to remove CaO. The resultant residue is vacuum-dried to obtain a pure R—T—M(—B) mother alloy.

The R—T—M(—B) mother alloy thus obtained may be subjected to the same homogenizing heat treatment, hydrogenation/decomposition reaction treatment, dehydrogenation/recombination reaction treatment, and nitriding treatment as in EXAMPLE 7, to obtain the nitride-type, rare earth magnet material powder of the present invention. To improve $(BH)_{max}$, it is preferable that the Ca content is 0.1 weight % or less, the oxygen content is 0.25 weight % or less, and the carbon content is 0.1 weight % or less.

Also, the R—T—M(—B) mother alloy produced by an atomizing method or an arc-melting method may be subjected to the same homogenizing heat treatment, hydrogenation/decomposition reaction treatment, dehydrogenation/recombination reaction treatment and nitriding treatment as in EXAMPLE 7, to obtain the nitride-type, rare earth magnet material powder of the present invention.

Further, the thin mother alloy ribbon produced by a melt-quenching in EXAMPLE 1 may be subjected to same homogenizing heat treatment, hydrogenation/decomposition reaction treatment, dehydrogenation/decombination reaction treatment and nitriding treatment as in EXAMPLE 7, to obtain the nitride-type, rare earth magnet material powder of the present invention.

In each nitride-type, rare earth magnet material powder in the above EXAMPLES, the oxygen content is 0.1 weight % or less, and the carbon content is less than 0.1 weight %. Accordingly, it has high magnetic properties suitable for practical applications with decreased α-Fe.

Though the above EXAMPLES show the production of isotropic, bonded magnets by a compression-molding method, isotropic moldings can be produced, for instance by preparing compounds of nitride-type, rare earth magnet material powders and thermoplastic resins such as polyamide resins, ethylene-ethyl acrylate copolymer resins, etc. and injection-molding or compression-molding them.

APPLICABILITY IN INDUSTRY

As described above, the nitride-type, rare earth magnet material powder of the present invention is composed of an R—T—M(—B)—N alloy with extremely few or even no α-Fe, and the alloy is substantially constituted by a fine hard magnetic phase having an $R_2T_{17}$-type structure. Accordingly, it has excellent magnetic properties such as iHc, $(BH)_{max}$, a temperature coefficient of iHc, a squareness ratio, etc. The isotropic, bonded rare earth magnet comprising this nitride-type, rare earth magnet material powder has not only excellent magnetic properties but also high density, and further is excellent in heat resistance and magnetizability. Such nitride-type, rare earth magnet materials and bonded rare earth magnets are suitably used for rotors of spindle motors for automobiles and electric appliances, actuators for voice coil motors, etc.

What is claimed is:

1. A nitride, rare earth magnet material having a basic composition represented by:

$$R_\alpha T_{100-(\alpha+\beta+\gamma+\delta)} M_\beta B_\gamma N_\delta \text{ (atomic \%)},$$

wherein R is at least one rare earth element including Y, where as a rare earth element Sm must be present, T is Fe alone or a combination of Fe and Co and/or Ni, M is at least one element selected from the group consisting of Al, Ti, V, Cr, Mn, Cu, Ga, Zr, Nb, Mo, Hf, Ta, W and Zn, $6 \leqq \alpha \leqq 15$, $0.5 \leqq \beta \leqq 10$, $0 \leqq \gamma \leqq 4$, and $4 \leqq \delta \leqq 30$, said nitrided, rare earth magnet material being substantially composed of a hard magnetic phase of an $R_2T_{17}$ structure having an average crystal grain size of 0.01–1 μm, and an average area ratio of α-Fe being 5% or less.

2. The nitride, rare earth magnet material according to claim 1, wherein M is at least one element selected from the group consisting of Al, Ti, V, Cr, Mn, Cu, Ga, Zr, Nb, Mo, Hf, Ta, W and Zn, wherein Ti must be present, and $6 \leqq \alpha \leqq 15$, $0.5 \leqq \beta \leqq 10$, $0.1 \leqq \gamma \leqq 4$, and $4 \leqq \delta \leqq 30$.

3. The nitride, rare earth magnet material according to claim 1, wherein R is Sm and La, the content of La being 0.05–1 atomic % based on the overall basic composition (100 atomic %).

4. The nitrided, rare earth magnet material according to claim 1, wherein said hard magnetic phase is composed of a mixed crystal of a rhombohedral crystal having a $Th_2Zn_{17}$ structure and a hexagonal crystal having a $Th_2Ni_{17}$ structure.

5. The nitride, rare earth magnet material according to claim 1, wherein said nitride, rare earth magnet material is in the form of powder having a one-peak particle size distribution with an average particle size of 10–300 μm.

6. The nitride, rare earth magnet material according to claim 1, containing as inevitable impurities 0.25 weight % or less of oxygen and 0.1 weight % or less of carbon.

7. The nitride, rare earth magnet material according to claim 1, produced by subjecting a mother alloy having substantially the same composition as said basic composition except for containing no nitrogen to rapid quenching at a peripheral speed of a quenching roll that is 0.05–15 m/second to produce a thin ribbon, followed by a homogenizing heat treatment at 1010–1280° C. for 1–40 hours in an inert gas atmosphere containing no nitrogen, a hydrogenation/decomposition reaction treatment by heating at 675–900° C. for 0.5–8 hours in hydrogen gas at 0.1–10 atm or in an inert gas atmosphere, excluding nitrogen gas, having a hydrogen partial pressure of 0.1–10 atm, a dehydrogenation/recombination reaction treatment by heating at 700–900° C. for 0.5–10 hours in vacuum of $1\times10^{-1}$ Torr or less, and then a nitriding treatment.

8. A bonded rare earth magnet substantially composed of powder of the nitride, rare earth magnet material as recited in claim 1 bonded with a binder.

9. The bonded rare earth magnet according to claim 8, produced by bonding of said rare earth magnet material powder with a thermosetting resin, compression molding and a heat curing treatment, said bonded rare earth magnet having a density of more than 6.1 g/cm$^3$.

* * * * *